US006699107B2

(12) United States Patent
Stoeckgen et al.

(10) Patent No.: US 6,699,107 B2
(45) Date of Patent: Mar. 2, 2004

(54) POLISHING HEAD AND APPARATUS WITH AN IMPROVED PAD CONDITIONER FOR CHEMICAL MECHANICAL POLISHING

(75) Inventors: Uwe Gunter Stoeckgen, Dresden (DE); Gerd Franz Christian Marxsen, Radebeul (DE)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 10/209,739

(22) Filed: Jul. 31, 2002

(65) Prior Publication Data

US 2003/0162486 A1 Aug. 28, 2003

(30) Foreign Application Priority Data

Feb. 27, 2002 (DE) ..... 102 08 414

(51) Int. Cl.[7] ..... B24B 7/00
(52) U.S. Cl. ..... 451/72; 451/56; 451/289
(58) Field of Search ..... 451/72, 41, 56, 451/63, 285, 287, 288, 289, 443, 444; 156/345.12, 345.14

(56) References Cited

U.S. PATENT DOCUMENTS

| | | | | |
|---|---|---|---|---|
| 5,569,062 A | * | 10/1996 | Karlsrud | 451/285 |
| 5,749,771 A | | 5/1998 | Isobe | 451/41 |
| 5,902,173 A | | 5/1999 | Tanaka | 451/56 |
| 5,906,754 A | * | 5/1999 | Appel et al. | 216/88 |
| 5,913,714 A | | 6/1999 | Volodarsky et al. | 451/41 |
| 5,931,725 A | | 8/1999 | Inaba et al. | 451/288 |
| 6,004,193 A | * | 12/1999 | Nagahara et al. | 451/285 |
| 6,004,196 A | * | 12/1999 | Doan et al. | 451/443 |
| 6,019,670 A | * | 2/2000 | Cheng et al. | 451/56 |
| 6,139,428 A | | 10/2000 | Drill et al. | 457/41 |
| 6,231,428 B1 | * | 5/2001 | Maloney et al. | 451/41 |
| 6,271,140 B1 | | 8/2001 | Chang | 438/692 |
| 6,302,770 B1 | * | 10/2001 | Aiyer | 451/56 |
| 6,309,290 B1 | * | 10/2001 | Wang et al. | 451/398 |
| 6,350,184 B1 | | 2/2002 | Holzapfel | 451/72 |
| 6,409,579 B1 | * | 6/2002 | White et al. | 451/56 |
| 6,447,380 B1 | * | 9/2002 | Pham et al. | 451/288 |
| 6,565,705 B2 | * | 5/2003 | Hung et al. | 156/345.12 |

FOREIGN PATENT DOCUMENTS

| | | | |
|---|---|---|---|
| EP | 0 770 454 A1 | 5/1997 | B24B/37/04 |
| JP | 2001009710 A | 1/2001 | B24B/37/04 |
| WO | WO 00/78504 A1 | 12/2000 | B24B/37/04 |

* cited by examiner

*Primary Examiner*—Joseph J. Hail, III
*Assistant Examiner*—David B. Thomas
(74) *Attorney, Agent, or Firm*—Williams, Morgan & Amerson, P.C.

(57) ABSTRACT

A polishing head and an apparatus for the chemical mechanical polishing (CMP) of a substrate are provided in which a conditioning surface is integrated in or directly coupled to the polishing head so that a simplified structure of the CMP apparatus can be obtained. Furthermore, establishing quite similar pad conditions may be achieved. Preferably, the conditioning surface is integrated into the retaining element of sophisticated CMP apparatuses, thereby allowing the application of an adjustable pressure to the conditioning surface.

34 Claims, 4 Drawing Sheets

POLISHING HEAD AND APPARATUS WITH AN IMPROVED PAD CONDITIONER FOR CHEMICAL MECHANICAL POLISHING

BACKGROUND OF THE INVENTION

1. Field of the Invention

The present invention relates to the field of fabrication of integrated circuits, and more particularly, to a process tool used for the chemical mechanical polishing of substrates during the fabrication of integrated circuits.

2. Description of the Related Art

In modern integrated circuits, a huge number of semiconductor elements, such as field effect transistors, capacitors and the like, are fabricated on a single substrate. These individual semiconductor elements have to be connected to each other via so-called metallization according to the required functionality of the integrated circuit. To this end, a so-called interlayer dielectric is deposited above the devices, and vias and trenches are formed thereafter in the dielectric layer. The vias and trenches are then filled with an appropriate metal, for instance copper in sophisticated integrated circuits, to provide for the electrical connection of the individual semiconductor elements. Due to the ever-increasing number of semiconductor elements and the immense complexity of modern integrated circuits, typically a plurality of metallization layers must be stacked on top of each other to accomplish the functionality required.

As the number of metallization layers and, associated therewith, the number of dielectric layers to be stacked on top of each other have increased, the planarization of the individual stack layers at each process level has been found to represent an extremely critical manufacturing process. This problem is additionally exacerbated as the substrate area, i.e., the wafer diameter, is steadily increasing. Chemical mechanical polishing (CMP) is an appropriate and widely used process to achieve global planarization of a wafer. In the CMP process, a wafer is mounted on an appropriately formed carrier, a so-called polishing head, and the carrier is moved relative to a polishing pad while the wafer is in contact with the polishing pad. A slurry is supplied to the polishing pad during the CMP process and contains a chemical compound reacting with the material or materials of the layer to be planarized by, for example, converting the material into an oxide, and the reaction product, such as the metal oxide, is mechanically removed with abrasives contained in the slurry and the polishing pad. To obtain a required removal rate, while at the same time achieving a high degree of planarity of the layer, a combination of polishing pad, type of slurry, pressure applied to the wafer while moving relative to the polishing pad, and the relative velocity between the wafer and the polishing pad must appropriately be selected. The removal rate further significantly depends on the temperature of the slurry, which in turn is significantly affected by the amount of friction created by the relative motion of the polishing pad and the wafer, the degree of saturation of the slurry with ablated particles and, in particular, the state of the polishing surface of the polishing pad.

Most polishing pads are formed of a cellular microstructure polymer material having numerous voids which are filled by the slurry during operation. A densification of the slurry within the voids occurs due to the absorbed particles that have been removed from the substrate surface and accumulated in the slurry. As a consequence, the removal rate steadily decreases, thereby disadvantageously affecting the reliability of the planarizing process and thus reducing yield and reliability of the completed semiconductor devices.

To partly overcome this problem, typically a so-called pad conditioner is used that "reconditions" the polishing surface of the polishing pad. The pad conditioner may be comprised of a variety of materials, e.g., diamond that is covered in a resistant material. In such cases, the exhausted surface of the pad is ablated and/or reworked by the relatively hard material of the pad conditioner once the removal rate is assessed to be too low. In other cases, as in sophisticated CMP apparatuses, the pad conditioner is continuously in contact with the polishing pad while the substrate is polished. Whereas the first alternative leads to significant variations of the removal rate due to the difference of the reworked surface of the polishing pad compared to the exhausted surface present immediately before the conditioning, the latter alternative is not as effective as the former alternative in refreshing the pad surface, since a substantially softer conditioning material has to be used in order to not unduly shorten the lifetime of the polishing pad. Moreover, in sophisticated integrated circuits, process requirements concerning uniformity of the CMP process are very strict so that the state of the polishing pad has to be maintained as constant as possible over the entire area of a single substrate as well as for the processing of as many substrates as possible. Consequently, the pad conditioners are usually provided with a drive assembly and a control unit that allow the pad conditioner to be moved with respect to the polishing head to rework the polishing pad immediately before coming into contact with the substrate to be processed while avoiding interference with the movement of the polishing head. This additionally adds to the costs and complexity of presently known CMP apparatuses.

In view of the above-mentioned problems, there exists a need for an improved CMP tool allowing for a stable operation over a large plurality of substrates to be treated.

SUMMARY OF THE INVENTION

In general, the present invention is directed to a CMP tool having conditioners integrally formed with the polishing head to reduce cost and complexity of the tool while improving effectiveness and reliability.

According to one embodiment of the present invention, a polishing head for the chemical mechanical polishing of a substrate comprises a substrate holder configured to receive the substrate and to hold it in place during operation. The polishing head further comprises a joining element connectable to a drive assembly for moving the polishing head and a supply line that is connectable to a vacuum source and/or a gas source. Moreover, the polishing head comprises a pad conditioner coupled to the substrate holder.

According to a further embodiment, a polishing head for the chemical mechanical polishing of a substrate comprises a substrate holder configured to receive the substrate. Moreover, the polishing head includes a retaining element arranged to enclose the substrate and to keep it in place during operation of the polishing head, wherein the retaining element includes a conditioning surface.

In a further embodiment, an apparatus for the chemical mechanical polishing of a substrate comprises a polishing pad and a polishing head having formed therein a pad conditioning surface. Moreover, the apparatus includes the drive assembly for moving the polishing head relative to the polishing pad.

Pursuant to a further embodiment, an apparatus for the chemical mechanical polishing of a substrate comprises a polishing head for receiving, holding and moving the substrate.

The apparatus further comprises a polishing pad and a pad conditioner that is mechanically connected to the polishing head.

In a further embodiment, a polishing tool for a chemical mechanical polishing tool comprises a substrate holder configured to receive a substrate and a pad conditioner coupled to the substrate holder.

BRIEF DESCRIPTION OF THE DRAWINGS

The invention may be understood by reference to the following description taken in conjunction with the accompanying drawings, in which like reference numerals identify like elements, and in which.

Figure 1A:
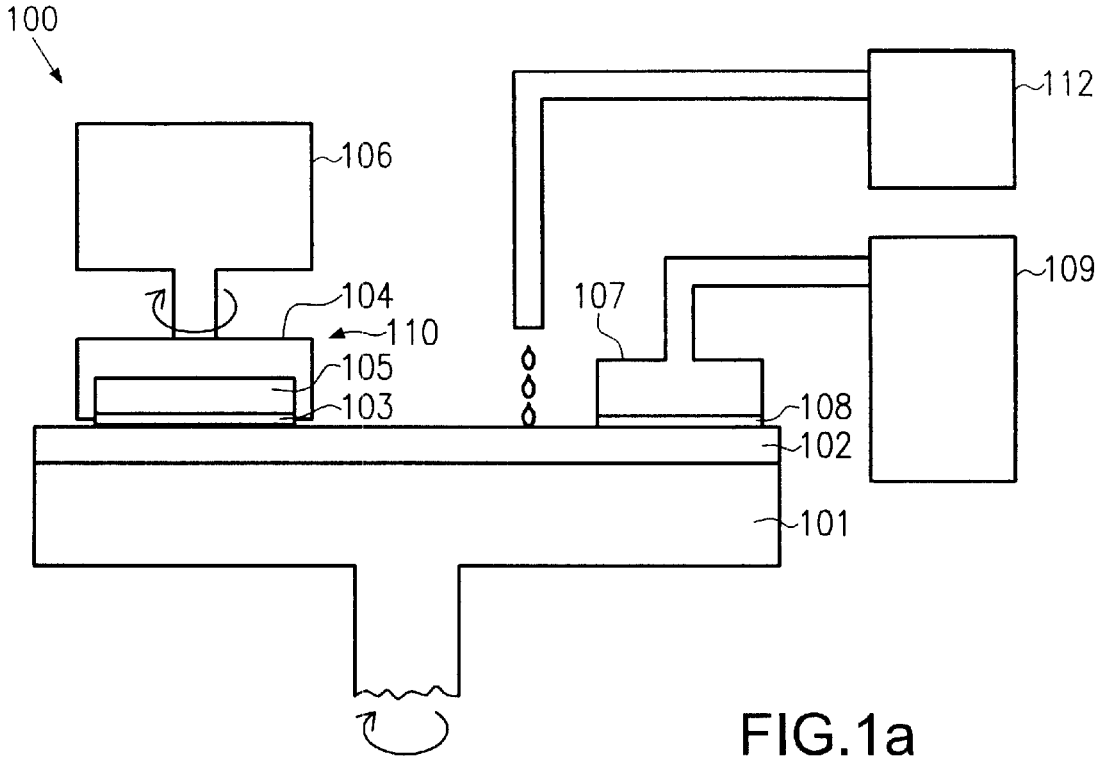
FIG. 1*a* schematically shows a typical conventional apparatus for chemical mechanical polishing, including a polishing head and a pad conditioner.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives failing within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. Although the various regions and structures of a semiconductor device are depicted in the drawings as having very precise, sharp configurations and profiles, those skilled in the art recognize that, in reality, these regions and structures are not as precise as indicated in the drawings. Additionally, the relative sizes of the various features and doped regions depicted in the drawings may be exaggerated or reduced as compared to the size of those features or regions on fabricated devices. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIG. 1*a* schematically depicts a conventional chemical mechanical polishing (CMP) tool 100. The tool 100 comprises a movable platen 101 on which a polishing pad 102 is mounted. A polishing head 110 includes a body 104 and a substrate holder 105 for receiving and holding a substrate 103. The polishing head 110 is coupled to a drive assembly 106. Spaced apart from the polishing head 110 is provided a pad conditioner 107 having a conditioning surface 108. The pad conditioner 107 is coupled to a drive assembly 109. Moreover, a slurry supply 112 is provided.

During operation of the tool 100, a slurry is supplied to the polishing pad 102 and is distributed across the rotating polishing pad 102 by contact with the conditioning surface 108 of the pad conditioner 107 and the substrate 103. Usually, one or more test substrates are processed prior to performing actual production processes to establish an appropriate condition of the polishing pad 102. In advanced tools 100, the rotating polishing head 110 is additionally moved across the polishing pad 102 to optimize the relative motion between the substrate 103 and the polishing pad 102. The pad conditioner 107 is moved in correlation to the polishing head 110 to provide for as uniform CMP conditions as possible for each substrate portion. The motion control of the pad conditioner 107 is performed so as to not interfere with the movement of the polishing head 110, thereby requiring a complex mechanical structure and a sophisticated controlling system.

Figure 1B:
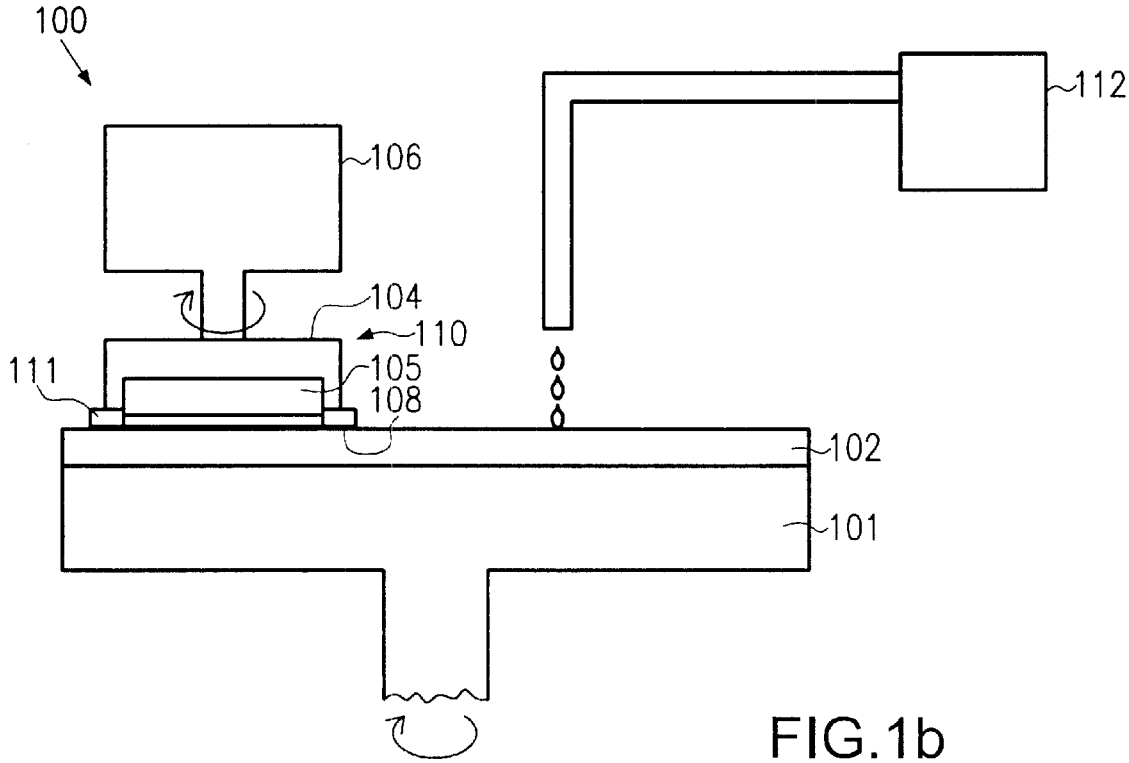
FIG. 1*b* schematically shows an apparatus for CMP including a polishing head with an integral conditioning surface.

In FIG. 1*b*, an illustrative embodiment of the present invention is schematically depicted, whereby for the sake of convenience parts similar to those depicted in FIG. 1 are indicated by the same numerals. Contrary to the conventional case, the tool 100 now comprises a polishing head 110 that includes a body 104, a substrate holder 105 with a retaining element 111 for keeping the substrate 103 in place during operation, wherein the retaining element 111 comprises a conditioning surface 108. In the tool 100 of FIG. 1*b*, the drive assembly 109 of the conventional apparatus is no longer required, thereby significantly simplifying the structure of the CMP tool 100 of FIG. 1*b*. Operation of a CMP tool similar to the tool 100 and especially of a polishing head having a similar structure as the polishing head 110 will be described in more detail with reference to FIG. 2.

Figure 2:
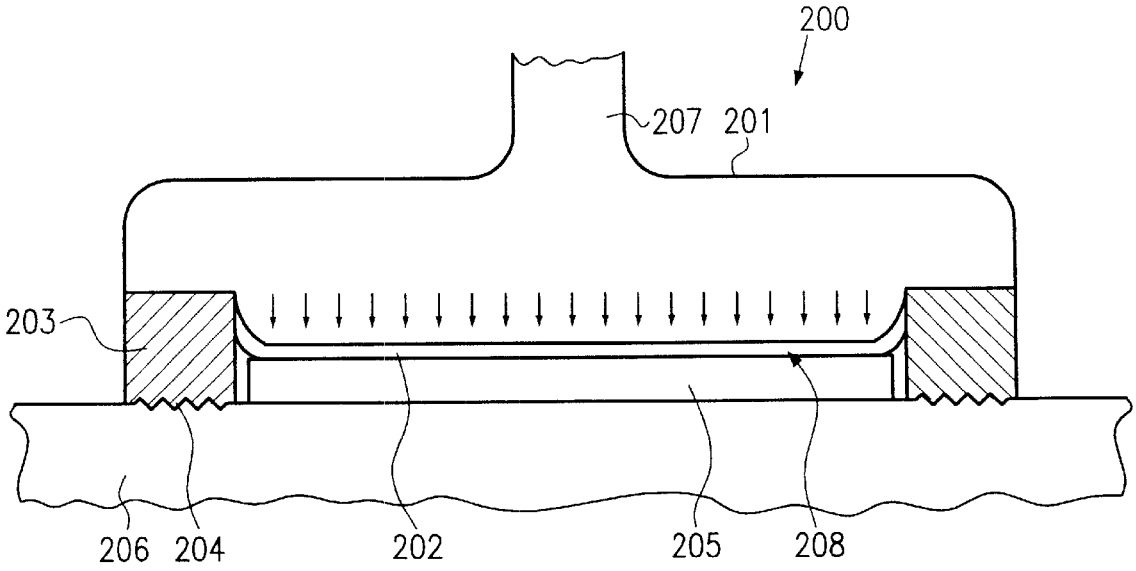
FIG. 2 shows a schematic cross-sectional view of a polishing head having formed therein a conditioning surface according to one embodiment.

FIG. 2 shows a schematic cross-sectional view of a polishing head 200 that is located on a polishing pad 206 (and that may be used in a CMP) tool as illustrated in FIG. 1*b*). The polishing head 200 includes a body 201 having formed therein a plurality of tiny fluid lines (not shown) for supplying negative and/or overpressure to a substrate 205 for attaching the substrate 205 to the polishing head 200 during transportation (vacuum) and to apply a required pressure during operation as indicated by the arrows. A joining member 207 is configured to be connectable to a drive assembly (not shown) and may additionally comprise a supply line for feeding gas and/or vacuum to the tiny fluid lines within the body 201. A membrane 202 is provided at a bottom side of the body 201 and defines a substrate receiving portion 208. A retaining element 203 is radially separated from the substrate receiving portion 208 and comprises a conditioning surface 204 having a texture and being formed of a material suitable for conditioning the polishing pad 206 during operation. The retaining element 203 may be removably attached to the body 201, for example by vacuum or any other means such as screws, etc. Alternatively, the retaining element 203 may be permanently attached to the body 201 by, for example, an adhesion means or by forming the retaining element 203 as an integral part of the body 201.

As previously pointed out, an important factor for a reliable and effective chemical mechanical polishing is the provision of stable operating conditions for as many substrates 205 as possible. In most CMP apparatuses, during operation, a relative motion between the substrate surface to be planarized and the polishing pad 206 is established in that the polishing head 200 is rotated and the polishing pad 206 is moved either linearly or is also rotated. Typically, the relative movement between the polishing head 200 and the polishing pad 206 and the pressure applied to the substrate 205 via the membrane 202 is controlled such that each surface portion of the substrate 205 experiences a substantially similar removal rate.

Since the conditioning surface 204 is provided integrally with the polishing head 200, by rotating the polishing head 200, each surface portion of the substrate 205 also experiences substantially the same conditioning activity exerted to the polishing pad 206 and the slurry contained therein or thereon. Moreover, since the relative motion between the polishing pad 106 and the polishing head 200 is precisely controllable by correspondingly driving the respective drive assemblies, a plurality of sequentially processed substrates 205 encounter essentially the same conditioning effect. By providing the conditioning surface 204 within the polishing head 200, not only an extremely stable and reproducible conditioning is attained, but also the provision of an individual conditioner mechanically decoupled from the polishing head 200, as used in conventional CMP apparatuses, may be rendered obsolete, thereby significantly simplifying the structure of the CMP apparatus as well as the complexity of the control operation for the separate conditioner of the conventional tool.

Figure 3A:
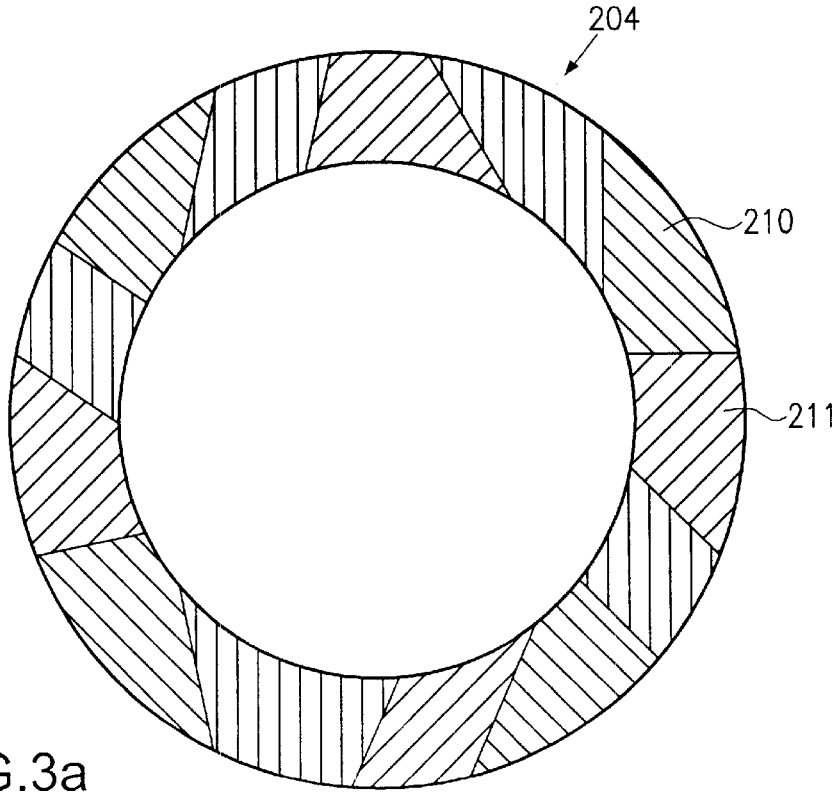
FIG. 3*a* is a schematic plan view of the conditioning surface of the polishing head shown in FIG. 2.

FIG. 3*a* shows a plan view of one illustrative embodiment of the conditioning surface 204 that comprises distinct surface portions 210 and 211. The surface portions 210 and 211 may be different in surface texture, pattern and/or material of which they are made. The material selected for the conditioning surface 204, which may comprise a plurality of distinct surface portions such as the portion 210 and 211 with a respective grooving 212, is selected in accordance with the material or materials that are to be removed from the substrate 205, the slurry that is to be used in this process and the type of polishing pad in the CMP apparatus. Suitable materials for the conditioning surface 204 for CMP processes performed on various material layers include diamond that is covered in a resistant material.

Figure 3B:
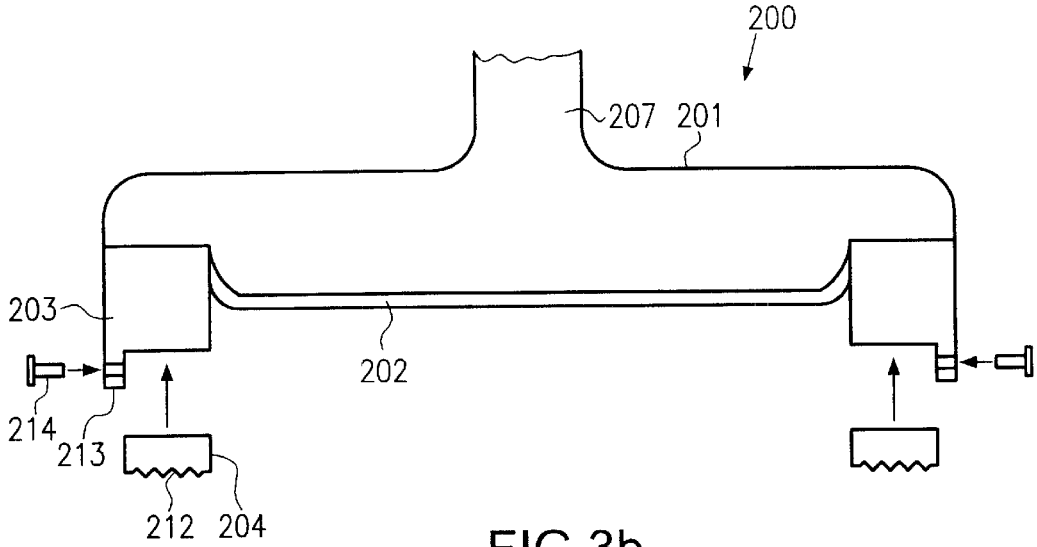
FIG. 3*b* schematically shows an embodiment, in which the conditioning surface of FIG. 3*a* is removably attached to the polishing head.

In FIG. 3*b*, one illustrative embodiment is schematically depicted in a cross-sectional view, wherein the conditioning surface 204 is provided as a separate ring made of an appropriate material having a well-suited surface texture and is removably attached to the retaining element 203. Attaching the conditioning surface 204 to the retaining element 203 may be accomplished by, for example, providing an edge 213 at the perimeter of the retaining element 203 and fixing the conditioning surface 204 with one or more screws 214 or the like. It is to be understood that the removable attachment of the conditioning surface 204 may be obtained by any other appropriate means, such as a vacuum applied to the conditioning surface, and the like.

Thus, the polishing head 200 is easily adaptable to a plurality of different CMP process recipes by simply selecting an appropriate separate ring. It is to be noted that although the retaining element 203 is described as a ring-shaped element, in other embodiments the retaining element 203 and/or the conditioning surface 204 may have any appropriate configuration.

Figure 4:
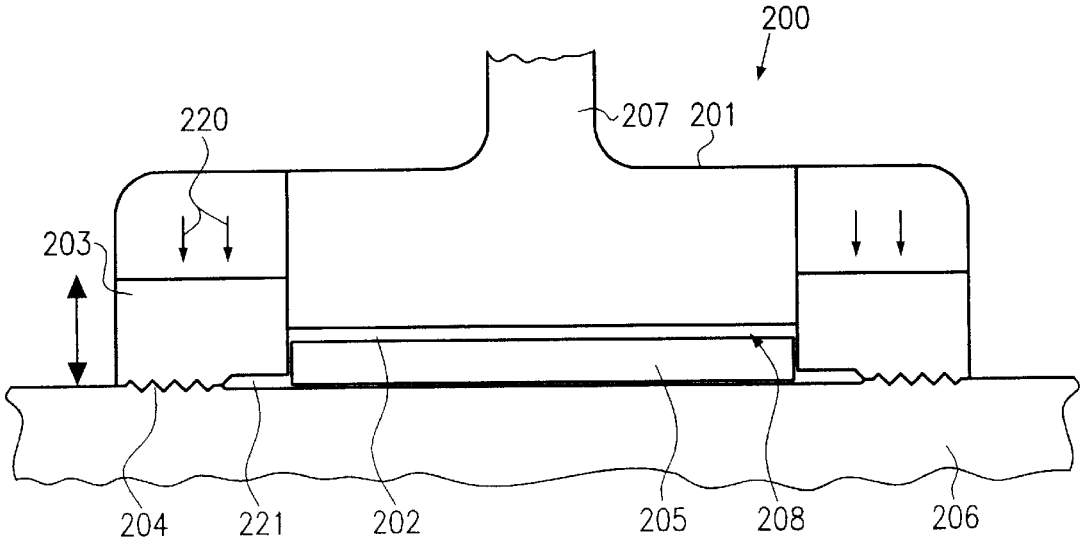
FIG. 4 is a schematic cross-sectional view of a polishing head pursuant to another illustrative embodiment.

FIG. 4 schematically shows another embodiment of the polishing head 200 wherein for the sake of convenience the same reference numerals are adhered to as in FIGS. 2 and 3. In this embodiment, the retaining element 203, and thus the conditioning surface 204, is attached to the body 201 in such a manner that relative vertical movement may be provided between the conditioning surface 204 and the body 201. This relative vertical movement may be accomplished by a variety of techniques. For example, in one illustrative embodiment, the relative movement is accomplished by a required pressure applied to the retaining element 203 as indicated by the arrows 220.

During operation of the polishing head 200, a specified pressure is applied to the retaining element 203 and thus to the conditioning surface 204 to adjust the force the conditioning surface 204 exerts to the polishing, pad 206 to a required level. This allows control of the conditioning effect of the conditioning surface 204 regardless of the pressure applied to the substrate 205 in order to control the removal rate. Consequently, at the end of the lifetime of the polishing pad 206 and/or of the conditioning surface 204, a more intensive conditioning force may be required than at the beginning of the service life so as to maintain stable polishing conditions.

In one embodiment, the conditioning surface 204 may vary in the radial direction, for example with respect to surface roughness and profile or type of material, or may comprise surface portions that are substantially not in contact with the polishing pad 206, such as portions 221 in FIG. 4. The portions 221 allow flow of the slurry at the inner perimeter of the conditioning surface 204 in a similar fashion as at the outer perimeter during operation. In one illustrative embodiment, the portions 221 may be adjusted to the same height as the working surface of the substrate 205 to be planarized so that the peripheral region of the substrate 205 "experiences" substantially the same pad condition as the substrate portions located radially more inwardly, that is, the slurry in the inner substrate surface portions "sees" a "closed" surface, whereas the slurry at the perimeter would, without the portions 221 positioned at the same height as the substrate, encounter an "open" environment. The grooving 212 on the portions 210, 211 may differ in, for example, depth and/or pitch as well as in the direction. For example, the grooving 212 in one portion, e.g., the portion 210, may be well-suited for re-working the surface of the polishing pad 206, i.e., having a grooving 212 with intensively engaging groove section, whereas the grooving 212 of another portion, such as the portion 211, may exhibit a grooving that is adapted to promote flow of the slurry from and to the substrate 205.

Figure 5:
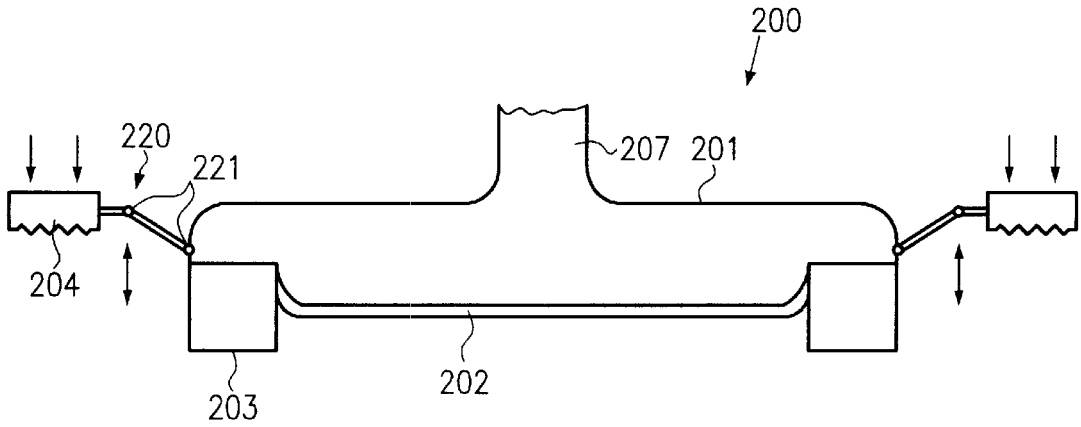
FIG. 5 schematically depicts an illustrative embodiment including a support member for supporting the conditioning surface.

FIG. 5 schematically shows a further embodiment, in which the polishing head 200 comprises a conditioning surface 204 that is attached to a support member 220, which in turn is mechanically coupled directly to the polishing head 200, for example by joint elements 221. The support member may represent a type of frame at least partially surrounding the polishing head 200 and may be removably attachable to the polishing head 200 or may be permanently attached. The mechanical connection to the polishing head 200 ensures that the support member is moved in the same manner as the polishing head 200. In the embodiment depicted in FIG. 5, at least a portion of the support member 220 is vertically movable with respect to the polishing head 200 by means of the joint elements 221 so that a force exerted to the polishing pad 206 by the conditioning surface 204 is adjustable by, for example, pressure applied to the support member 220, as indicated by the arrows in FIG. 5, or weight elements (not shown) attached to the support member.

Although the embodiments described so far refer to a rotating polishing head and a rotating polishing pad, the embodiments are also applicable to a linearly driven polishing pad, such as a belt-driven pad. The provision of a conditioning surface within the polishing head significantly contributes to more reliable conditions during the CMP process. Moreover, by integrating the conditioning surface into the retaining element of a polishing head, such as a retaining ring, the present invention may be easily implemented in already existing apparatuses, whereby the conventional conditioner may additionally be used or removed.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A polishing head for a chemical mechanical polishing tool, comprising:

a substrate holder configured to receive a substrate and to hold it in place;

a joining member connectable to a drive assembly for moving the polishing head;

a supply line connectable to at least one of a vacuum source and a gas source; and a pad conditioner coupled to the substrate holder, the pad conditioner comprising an exchangeable conditioning surface that is attachable by applying a vacuum to the conditioning surface.

2. The polishing head of claim 1, wherein the substrate holder further comprises a receiving surface and a retaining element adjacent to at least a portion of the receiving surface, whereby the retaining element comprises the pad conditioner.

3. The polishing head of claim 2, wherein the retaining element is substantially ring-shaped and a surface portion of the retaining element is configured as the pad conditioner.

4. The polishing head of claim 1, wherein the pad conditioner is height adjustable.

5. The polishing head of claim 1, wherein said pad conditioner is vertically movable with respect to said substrate holder.

6. The polishing head of claim 1, wherein a pressure may be operatively applied to said pad conditioner.

7. A polishing head for a chemical mechanical polishing tool, comprising:

a substrate holder configured to receive a substrate; and a retaining element arranged to enclose the substrate and to keep it in place during a polishing operation, wherein the retaining element includes a conditioning surface comprising a first surface portion and a second surface portion, the first surface portion being located radially inwardly of the second surface portion and being different in at least one of height, surface texture and type of material.

8. The polishing head of claim 7, wherein the retaining element is height adjustable.

9. The polishing head of claim 7, wherein a bearing pressure of the retaining element is adjustable.

10. The polishing head of claim 7, wherein the retaining element is substantially ring-shaped.

11. The polishing head of claim 7, wherein the retaining element is substantially made of a material suitable for being used for pad conditioning.

12. The polishing head of claim 7, wherein the conditioning surface is removably attached to the retaining element.

13. The polishing head of claim 7, wherein the conditioning surface includes a plurality of surface portions being different in at least one of surface texture and type of material provided in each of the surface portions.

14. An apparatus for the chemical mechanical polishing of a substrate, comprising:

a polishing pad, a polishing head comprising a retaining element, the retaining element being height adjustable and having formed thereon a pad conditioning surface, wherein the paid conditioning surface is removably attachable to the retaining element; and a drive assembly for providing a relative motion between the polishing pad and the polishing head.

15. The apparatus of claim 14, wherein a bearing pressure of a retaining element is adjustable.

16. The apparatus of claim 14, wherein a retaining element is substantially ring-shaped.

17. The apparatus of claim 14, wherein a retaining element is substantially made of a material suitable for being used for pad conditioning.

18. The apparatus of claim 14, wherein the conditioning surface includes a plurality of surface portions being different in at least one of surface texture and type of material provided in each of the surface portions.

19. The apparatus of claim 14, wherein the conditioning surface comprises a first surface portion and a second surface portion, the first surface portion being located radially inwardly of the second surface portion.

20. An apparatus for the chemical mechanical polishing of a substrate, comprising:

a polishing head for receiving, holding and moving the substrate;

a polishing pad; and a pad conditioner mechanically coupled to the polishing head, wherein the pad conditioner comprises a conditioning surface that is attachable by applying a vacuum to the conditioning surface.

21. The apparatus of claim 20, wherein the pad conditioner comprises a frame-like support member at least partially surrounding the polishing head.

22. The apparatus of claim 21, wherein the support member is height-adjustable.

23. The apparatus of claim 21, wherein the support member includes a conditioning surface to form the pad conditioner.

24. The apparatus of claim 23, wherein the conditioning surface is removably attachable to the support member.

25. The apparatus of claim 23, wherein the conditioning surface comprises two or more different surface portions differing in at least one of surface texture and type of material.

26. The apparatus of claim 23, wherein a bearing pressure of the support member is adjustable.

27. A polishing tool for a chemical mechanical polishing tool, comprising:

a substrate holder configured to receive a substrate and comprising a receiving surface and a retaining element adjacent to at least a portion of the receiving surface, wherein the retaining element is removably attachable to said substrate holder by applying a vacuum; and a pad conditioner coupled to said substrate holder.

28. The tool of claim 27, further comprising a drive assembly operatively coupled to said substrate holder.

29. The tool of claim 28, further comprising at least one supply line connected to at least one of said substrate holder and said pad conditioner, said supply line adapted to supply at least one of a vacuum pressure and a pressurized fluid to at least one of said substrate holder and said pad conditioner.

30. The tool of claim 27, wherein the retaining element is substantially ring-shaped and a surface portion of the retaining element is configured as the pad conditioner.

31. The tool of claim 27, wherein the pad conditioner comprises an exchangeable conditioning surface.

32. The tool of claim 27, wherein the pad conditioner is height-adjustable.

33. The tool of claim 27, wherein said pad conditioner is vertically movable with respect to said substrate holder.

34. The tool of claim 27, wherein a pressure may be operatively applied to said pad conditioner.

* * * * *